US005111674A

United States Patent [19]

Huang

[11] Patent Number: 5,111,674

[45] Date of Patent: May 12, 1992

[54] SAFE LOCKING MECHANISM

[76] Inventor: Ho-Ton Huang, 8822 N.E. 10th St., Bellevue, Wash. 98004

[21] Appl. No.: 583,728

[22] Filed: Sep. 17, 1990

[51] Int. Cl.[5] ..... E05B 63/14

[52] U.S. Cl. ..... 70/118; 292/34

[58] Field of Search ..... 70/118, 119, 120, 129, 70/133, 134; 292/32, 34, 37, 150, 179, DIG. 27

[56] References Cited

U.S. PATENT DOCUMENTS

| | | | |
|---|---|---|---|
| 2,801,869 | 8/1957 | George | 292/DIG. 27 |
| 2,823,536 | 2/1958 | Watson | 70/118 |
| 4,470,277 | 9/1984 | Uyeda | 292/54 |
| 4,926,664 | 5/1990 | Gartner | 70/119 |

*Primary Examiner*—Renee S. Luebke
*Assistant Examiner*—Suzanne L. Dino
*Attorney, Agent, or Firm*—Christensen, O'Connor, Johnson & Kindness

[57] ABSTRACT

A locking mechanism is adapted to be attached to the inside surface (31) of a safe door (30) or the like. A key lock (12) with a bolt (18) secures to the inside of the door. A lock pin body (14) has a ledge (22) to which are secured lock pins (24) and depending from the ledge (22) is an actuator section (20) have vertical guide slots (48 and 50). A slide plate (16) is designed for movement on the face of actuator section (20). The slide plate (16) is biased against bolt (18) and has two slots (80 and 82). To unlock the safe door the lock bolt (18) is retracted by key or combination so that the slide plate latch follows under spring tension. A shaft extending from the door exterior through actuator section (20) and one of the guide slots (50) is engaged by one of the slots (80) of the slide plate latch and when rotated moves the body (14) down to disengage the lock pins (24) from their locking elements in the safe casing.

8 Claims, 4 Drawing Sheets

SAFE LOCKING MECHANISM

FIELD OF THE INVENTION

The invention relates to the field of safe and strong box locking devices, and more particularly to a locking mechanism which utilizes a double locking device similar to a double dead bolt lock.

BACKGROUND OF THE INVENTION

As those skilled in the art are aware, there are a wide variety of locking mechanisms available in the market place for door-type safes and strong boxes. Some are actuated electronically and others are based on conventional combination or key lock systems that have been used for decades. Electronic type locking mechanisms usually actuate mechanical systems that are notoriously old in the art. However, electronically actuated systems are more likely to be used with larger and more sophisticated vaults holding valuable metals like gold and silver, jewels, cash, important documents and sensitive electronic data banks. Such vaults or safes are found in banks and other businesses that require highly developed tamper proofing and break-in resistance including elaborate electronic codes and timing mechanisms. Such installations are so complicated and expensive as to be far beyond the means and/or needs of private residences, or small and medium sized businesses. Some locking mechanisms are too complicated and physically occupy too much space to be of practical use in small inexpensive safes with limited space inside.

Combination type locks and key locks are much more vulnerable to theft losses since they are not difficult to break into, damage or to penetrate by a skilled safecracker. Thus, it is well recognized that improvements in locking mechanisms are needed which increase a safe's resistance to unauthorized penetration.

The prior art of which applicant is aware includes Taiwanese Patent No. 75/210258 which shows a safe locking mechanism which combines a complex connecting linkage and a combination number lock together into an integrated structure having a spring which if worn or damaged or dislocated will render the locking device inoperative.

U.S. Pat. No. 4,926,664 to Gartner et al. shows a link 23 which is engaged by a bolt 63 and moved with an element 19 and pin 22. When the link 23 is moved the bolts 30 and 31 are extended or retracted by virtue of the slots 34 and 35 acting on pins 36 and 37.

U.S. Pat. No. 4,470,277 to Uyeda shows a similar locking mechanism with a bar 40 moving the bolts 22 in and out as the angled slots 44 act on pins 26.

None of the three references above noted resembles the instant device either structurally or in operating principles. Thus, they are of interest only.

SUMMARY OF THE INVENTION

The locking device of the present invention utilizes a double element assembly in which a key lock bolt is operatively engaged by, but not connected to, a slide plate. The slide plate must be rotated in order for the locking pins to disengage. When the bolt is retracted, the plate slides and can be turned by a knob on the front of the door. When the knob on the front of the door is turned, a locking body carrying a plurality of locking pins is retracted by translation of the rotary motion of the slide plate into rectilinear motion of the locking body supporting the locking pins. Spring means bias the slide plate against the key bolt. Unless the key bolt is retracted and unless the slide plate is moved, there is no way to rotate the slide plate to actuate the locking body.

Accordingly, it is among the many features and advantages of the present invention to provide a novel antitheft locking mechanism which is simple, rugged, inexpensive and has a long life. If the key lock or switch is damaged, then the key lock bolt will dead lock unless the thief can cause the key bolt to retract. The slide plate can only be turned by the finger knob on the door, but until the plate slides, the knob is inoperative. Thus, there is a double locking or unlocking action which must be activated before the safe door can be opened. Tension springs bias the slide plate against the key lock bolt so that until the rotary motion is initiated by turning of the knob, the locking pins remain extended in the locking position.

DETAILED DESCRIPTION OF THE PREFERRED EMBODIMENT

Figure 1:
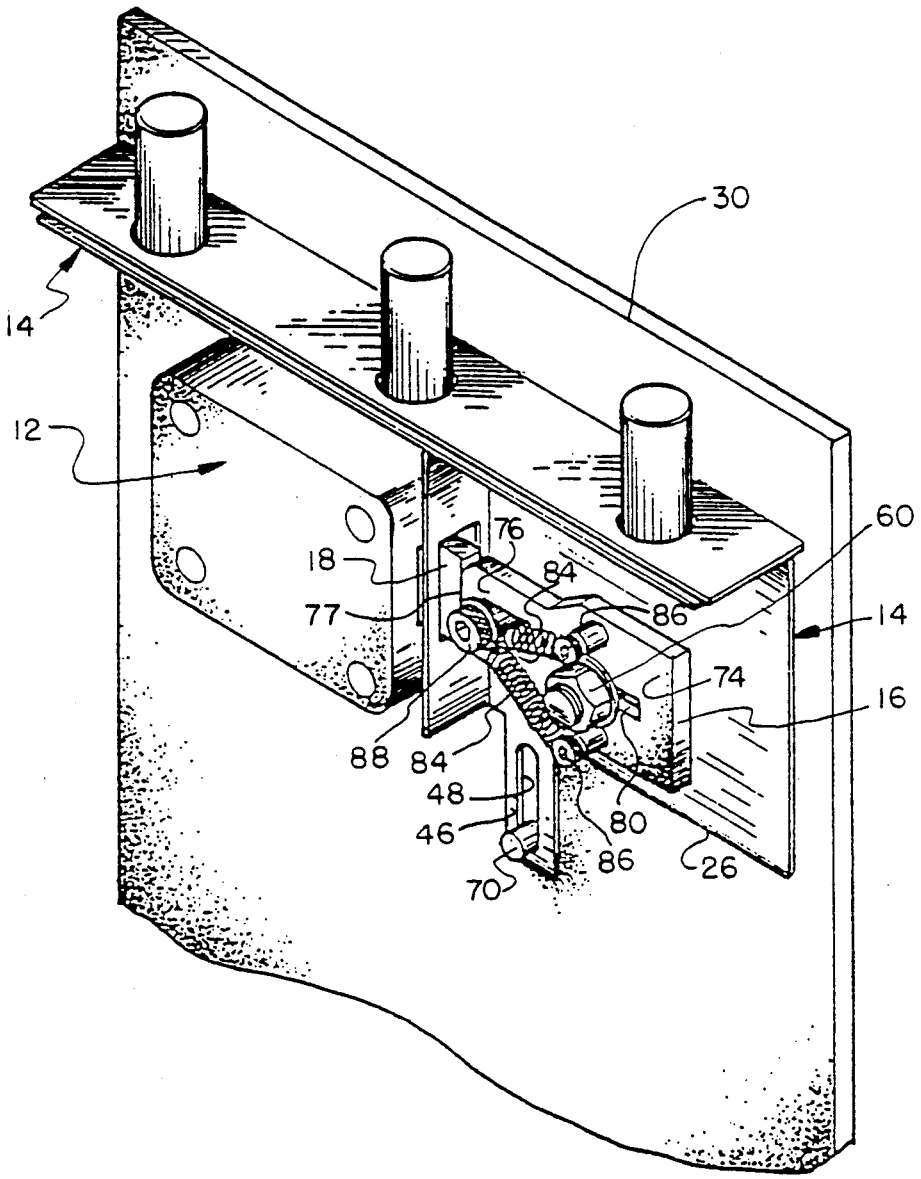
FIG. 1 is a perspective view of the locking mechanism of the present invention.
Figure 2:
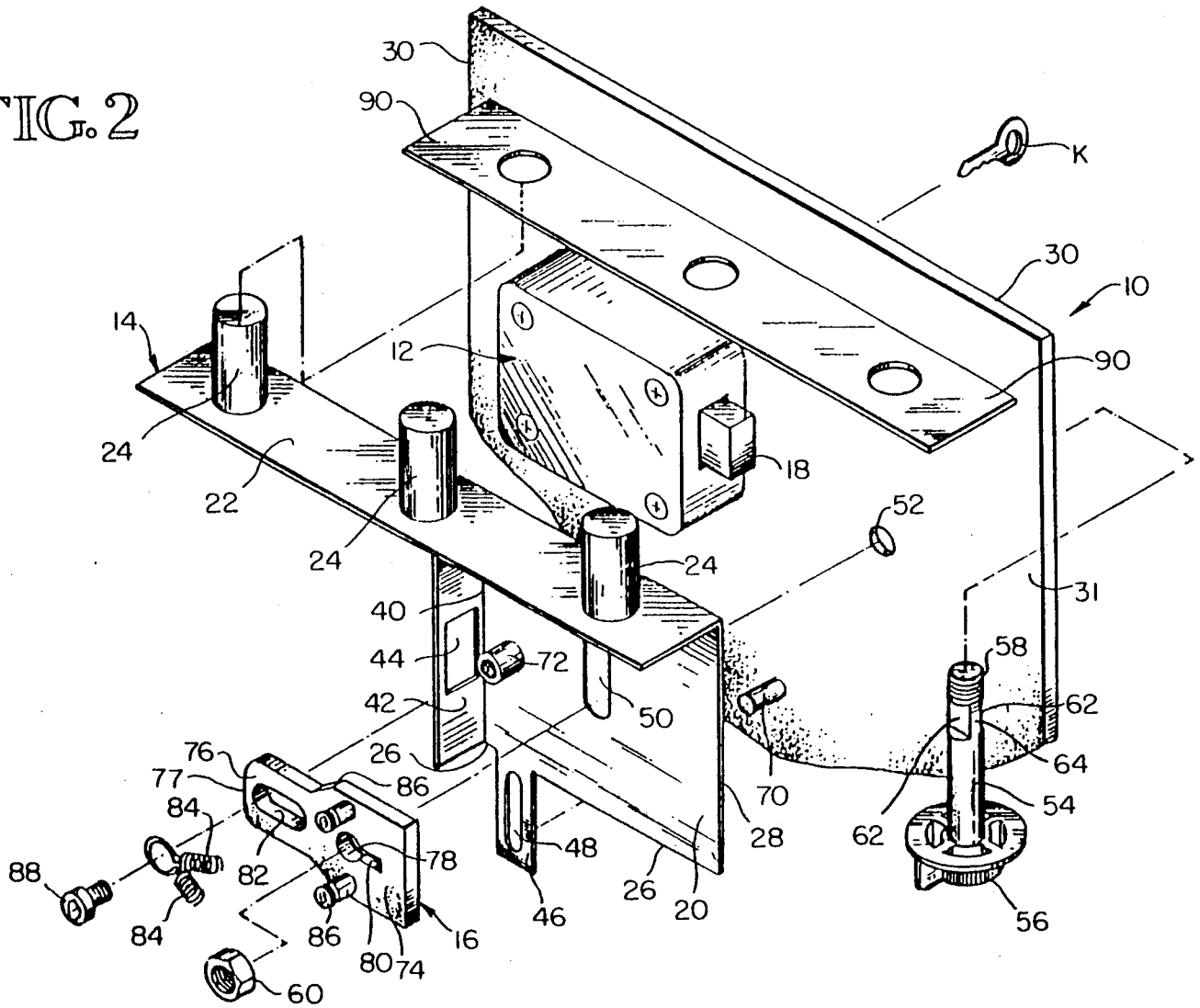
FIG. 2 is an exploded view in perspective of the components of the locking mechanism to further illustrate details of construction and operation.

Referring now to the drawings, particularly FIGS. 1 and 2, it will be seen that the improved locking mechanism of the present invention, which is generally designated by the number 10, attaches to the interior surface of a door 30 which has an interior surface 31. The invention includes key lock housing 12, lock pin actuator body 14 and slide plate member 16 as the major components of the structure.

On the front of door 30 is the key or rotary combination lock 34, or both together, which actuate the lock bolt 18 in housing 12 to extend or retract said lock bolt 18.

Mounted flat against the inside surface 31 of door 30 is a movable lock pin body 14 having a flat vertical actuator section 20 and a generally horizontal in mounting ledge 22 on which are supported a plurality of lock pins 24, in this instance three but which can be any desired number.

Lock pin body actuator section 20 extends downwardly to a lower edge 26 and includes outside edge 28 and inner edge 40 which represents about half the length of ledge 22. An outwardly extending piece 42 is connected to the edge 40 and to the underside of ledge 22 and extends downwardly to and aligns with bottom edge 26 of the actuator section 20. Extending downwardly from lower edge 26 is tongue 46 with elongated slot 48. Member 42 includes a rectangular opening 44 through which bolt 18 of the key lock housing 12 extends, as will be described in greater detail hereinafter. Also formed in the flat vertical actuator 20 is another elongated opening 50.

Formed in door 30 in alignment with elongated opening 50 is circular hole 52 through which a shaft 54 extends from the outside surface of the door into the lock assembly. Shaft 54 has finger knob 56 mounted thereon on the outside of the door. On its inner end shaft 54 is provided with threads 58 to receive retainer nut 60 shown in FIG. 1. Formed into shaft 54 are opposed parallel flat areas which define a narrow neck portion 64 which is located on the shaft just inside the actuator section 20 to engage slide plate member 16.

It will be seen that a pin 70 is fixed to the inside surface 31 of door 30 and positioned to align with elongated opening 48 in the tongue of lock pin body 14. Also on the inside surface of actuator section 20 is a support pin 72 which assists in positioning slide plate member 16 which will now be described.

The slide plate 16 is supported for slidable motion against the inside surface of actuator section 20 by bolt shaft 54 and nut 60. Slide plate 16 is an elongate member of predetermined thickness having a base section 74 and shallower forward section 76. Base section 74 includes a horizontal key hole shaped guide slot having a round end 78 and narrower part 80 with parallel spaced apart edges. Round part 78 of the guide slot aligns with shaft 54 when the lock mechanism is in its normally locked position. Another elongated horizontal opening 82 is formed in forward section 76 to receive pin 72 mounted on the actuator section of lock pin body 14. The forward portion 76 has engagement edge 77 for contacting bolt 18.

Slide plate member 16, as mentioned above, operatively engages pin 72 and slot 82 and further receives shaft 54 in round part 78 of the key hole slot. Two tension springs 84 are connected at one end to the mounting pins 86 on the larger base section 74 of slide plate 16. the other end of springs 84 are attached to pin 72 on actuator portion 20 of lock pin body 14. The ends of the springs are held securely in place by a lock screw 88 which threads into pin 72.

Figure 4:
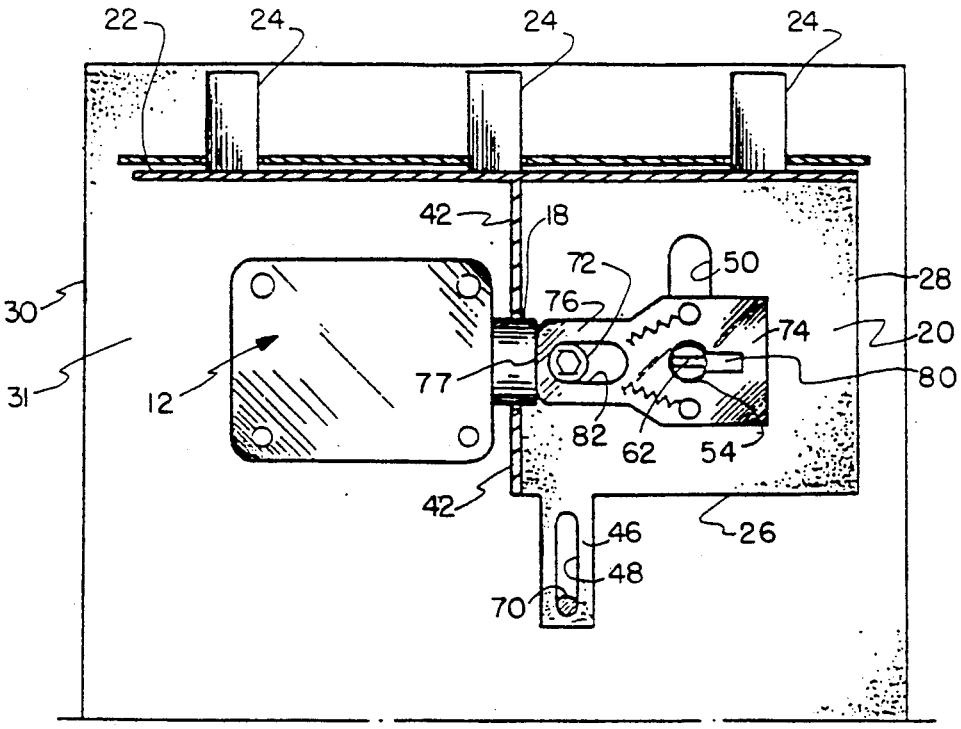
FIG. 4 is an elevation view of the mechanism when it is closed.
Figure 3:
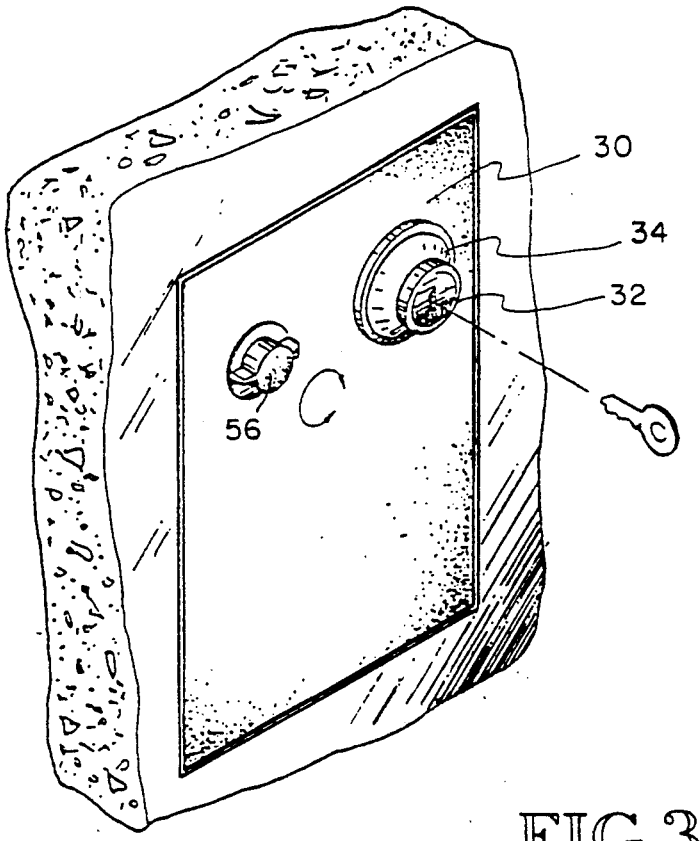
FIG. 3 shows an example of the key lock and auxiliary turning knob on the door of the safe which actuate the entire assembly.

In its normally locked position the device is as shown in FIGS. 1 and 4. In order to unlock the device, a key k or combination lock must retract bolt 18 of the key lock housing 12. However, when the bolt 18 is extended to its engaged or locked position as shown in FIG. 4 the slide plate member 16 is moved to the right against spring tension. Thus, in the locked position shaft 54 on which knob 56 is mounted is not engaged with the slide plate 16 and is free to rotate freely.

Figure 5:
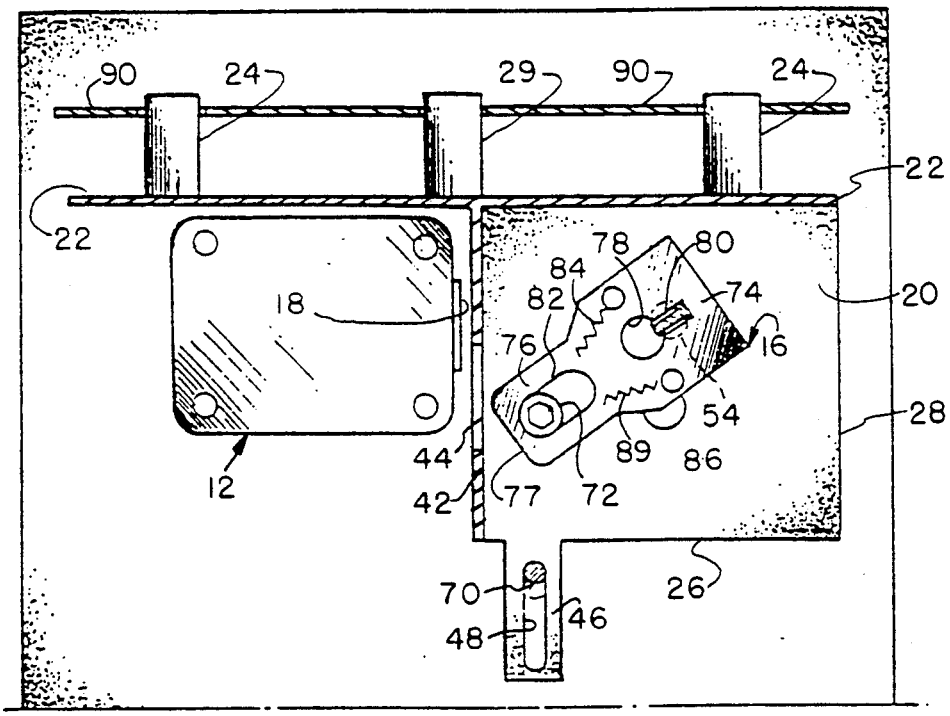
FIG. 5 is an elevation view showing the locking mechanism when it has been opened.

Again, retracting bolt 18 by key or combination allows the slide plate member 16 to move to the left because of the spring tension with edge 77 of the forward portion 76 following bolt 18. As soon as the flat narrow neck 64 slides into the slot 80, shaft 54 is operatively engaged with the slide plate. Knob 56 can then be turned clockwise to rotate the slide plate member 16 as shown in FIG. 5. The rotational movement of shaft 54 rotates slide plate 16 so that the lock pin body 14 moves downwardly. Thus, it will be appreciated that rotational movement is translated into rectilinear movement of body 14. Accordingly, lock pins 24 are moved downwardly and retracted to unlock the door. The elements which lock pins 24 would engage in the casing of the safe are not shown, and the strip 90 is merely to guide the pins 24 as they are extended and retracted from locked to unlocked position.

I claim:

1. A locking mechanism for mounting on the interior surface of safe doors and the like, comprising:

a) key lock housing means including a generally horizontal lock bolt having an extended locked position and a retracted unlocked position, said lock housing means including bolt activating means, b) a lock pin body means including lock pin members adapted to have a door locked and a door unlocked position depending on movement of said body means, said body means having a mounting ledge to which are connected said lock pin members for engaging locking elements and also having an actuator section which extends downwardly from said mounting ledge in close proximity to said interior surface adjacent said key lock housing means, said body means further including a generally vertically disposed guide slot means and a generally vertically disposed shaft slot means in the actuator section thereof, c) generally horizontally disposed slide plate latch means operatively connected to said actuator section and having a base section and a forward section, said base section being provided with a generally horizontal key hole shaped slot having a round end and a narrower rectangular end opening into said round end, said forward section having an elongated, generally horizontally disposed forward slot and a forward generally vertical front edge for engaging said locking bolt, d) a spring pin mounted on said actuator section and disposed to coact with said forward slot of said slide plate means, said slide plate means including spring means attached thereto and to said spring pin for biasing said slide plate means toward said key lock housing means so that said front edge contacts said lock bolt, e) rotatable shaft means extending through said door and through said shaft slot means of said actuator section and thence through said key hole slot of said slide plate means, said shaft means including a neck portion aligned with said slide plate means, whereby when said lock bolt is extended to its locked position said slide plate means is moved against spring tension to align said shaft means with said round end of said key hole shaped slot, and when said lock bolt is retracted to its unlocked position said slide plate means follows said lock bolt to align said neck portion of said shaft means with said rectangular end of said key hole slot and whereby rotational movement of said shaft means rotates said slide plate means to move said lock pin body means downwardly to disengage said lock pin members from their locking elements.

2. The locking mechanism according to claim 1 and wherein a body guide pin is secured to the interior surface of said door so as to coact with said guide slot means of said actuator section.

3. The locking mechanism according to claim 1 and wherein said guide slot means of said actuator section is elongated and is located below said slide plate latch means and said shaft slot means is also elongated.

4. The locking mechanism according to claim 1 and wherein said shaft means is provided with retaining nut means thereon for assuring that said lock pin body means and said slide plate latch means remain operatively connected to each other.

5. The locking mechanism according to claim 1 and wherein said slide plate latch means is provided with a pair of spaced apart spring anchoring pins and wherein said spring means comprises a pair of tension springs, each of which is attached at one end to an anchoring pin and at the other end to said spring pin on said actuator section.

6. The locking mechanism according to claim 2 and wherein said guide slot means of said actuator section is elongated and is located below said slide plate latch means and said shaft slot means is also elongated.

7. The locking mechanism according to claim 6 and wherein said shaft means is provided with retaining nut means thereon for assuring that said lock pin body means and said slide plate latch means remain operatively connected to each other.

8. The locking mechanism according to claim 7 and wherein said slide plate latch means is provided with a pair of spaced apart spring anchoring pins and wherein said spring means comprises a pair of tension springs, each of which is attached at one end to an anchoring pin and at the other end to said spring pin on said actuator section.

* * * * *